US006332283B1

(12) United States Patent
Archer

(10) Patent No.: US 6,332,283 B1
(45) Date of Patent: Dec. 25, 2001

(54) INDICATING MECHANISM

(75) Inventor: Timothy Mark Archer, Berkley (GB)

(73) Assignee: Bribex Limited, Yate Rocks (GB)

( * ) Notice: Subject to any disclaimer, the term of this patent is extended or adjusted under 35 U.S.C. 154(b) by 0 days.

(21) Appl. No.: 09/341,482

(22) PCT Filed: Jan. 8, 1998

(86) PCT No.: PCT/GB98/00050

§ 371 Date: Jul. 8, 1999

§ 102(e) Date: Jul. 8, 1999

(87) PCT Pub. No.: WO98/30997

PCT Pub. Date: Jul. 16, 1998

(30) Foreign Application Priority Data

Jan. 10, 1997 (GB) ..... 9700445
Apr. 26, 1997 (GB) ..... 9709432

(51) Int. Cl.[7] ..... G09F 7/10
(52) U.S. Cl. ..... 40/491; 40/601
(58) Field of Search ..... 40/601, 610, 491

(56) References Cited

U.S. PATENT DOCUMENTS 3,673,720 * 7/1972 Thornton ..... 40/601
4,827,644 5/1989 Trame .

FOREIGN PATENT DOCUMENTS 169306 8/1934 (CH) .
14881 * 6/1910 (GB) ..... 40/601
2061588 5/1979 (GB) .
2289156 8/1995 (GB) .

* cited by examiner

*Primary Examiner*—Cassandra H. Davis
(74) *Attorney, Agent, or Firm*—King and Schickli PLLC

(57) ABSTRACT

A price totem includes a carriage for carrying the display numbers at one or more vertical spaced number locations. The carriage has upper and lower portions which can be collapsed relative to each other enabling the construction of a large carriage which can still have its numbers changed at a single number changing station, which is accessible at ground level.

21 Claims, 3 Drawing Sheets

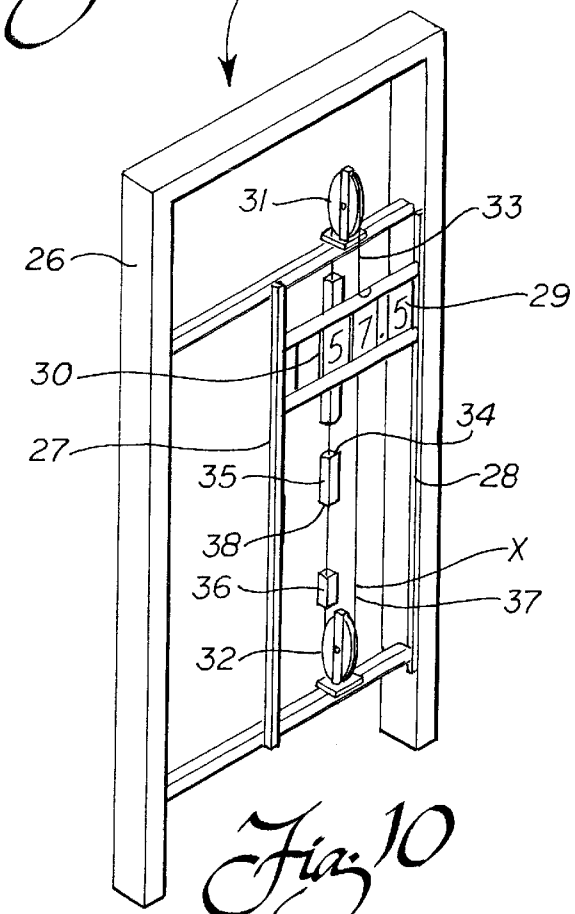
Fig 1
Fig 10
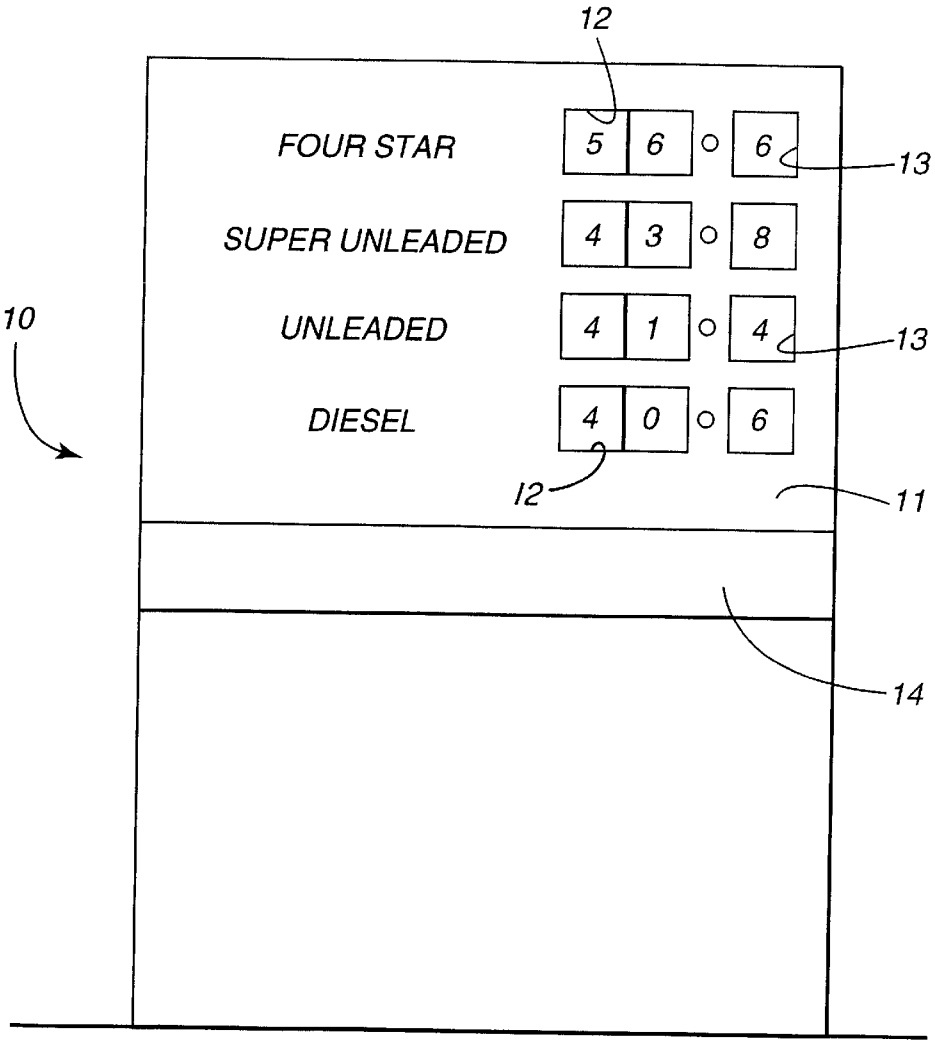

INDICATING MECHANISM

TECHNICAL FIELD

This invention relates to indicating mechanisms for price display devices and in particular, but not exclusively to the devices known as price totems.

BACKGROUND OF THE INVENTION

An indicating mechanism is described in our British Patent No. 2289156, the disclosure of which is incorporated into this Specification. The system described in that Patent has been particularly successful in the United Kingdom, although there are some existing price totems for which retro-fitting is not an option, because there is insufficient vertical space between the lowermost price window and the ground. Further, continental garages tend to offer at least five different fuels giving rise to the need for longer carriages.

SUMMARY OF THE INVENTION

The present invention consists in an indicating mechanism for a price display device comprising, a frame defining a vertical slide way, a carriage mounted in the slide way for movement between a display position and a storage position, the carriage defining a plurality of vertically spaced number locations such that the locations can be successfully disposed adjacent a number changing station as the carriage moves between its display and storage positions, characterised in that the carriage comprises upper and lower portions each bearing at least one number location, the portions being interconnected for relative vertical sliding movement whereby the carriage can be contracted when its lower portion is in the storage position.

In a preferred embodiment, the lower portion slides behind the upper portion to effect contraction. Conveniently the mechanism may include a stop or abutment for engaging the lower portion to initiate contraction and most simply that abutment may be constituted by the ground on which the mechanism or the device stands. The weight of the lower portion is preferably sufficient to re-extend the carriage when the carriage is raised to the display position, but means for urging the carriage into its extended position may be provided, or, alternatively, a temporary latch may be provided for briefly restraining the lower portion as the carriage is raised to the display position, so that the lower portion is braked relative to the upper portion causing the re-extension.

From a further aspect the present invention consists in an indicating mechanism comprising an indicating mechanism for a price display device comprising a frame defining a vertical slide way, a carriage mounted in the slideway for movement between a display position and a number change position, the carriage defining a number location and counterbalance means for counterbalancing the weight of the carriage, including a pulley mounted on the frame above the carriage and a counterbalance weight connected to an upper part of the carriage by a flexible elongate member which passes over the pulley characterised in that the mechanism includes a further pulley located below the number change station and a further flexible member connected to the weight, extending around the further pulley to the lower part of the carriage to form, with the carriage, a closed loop with the counterbalance means, whereby the carriage can be moved vertically in the desired direction by pulling on the further flexible member.

The mechanism of this aspect can include any of the features of our British Patent No. 2 289 156 or the other modifications described in this Application. The arrangement enables the system described in these cases to be used, however high the display locations are.

Although the invention has been defined above, it is to be understood it includes any inventive combination of the features set out above or in the following description.

BRIEF DESCRIPTION OF THE DRAWINGS

The invention may be performed in various ways and a specific embodiment will now be described, by way of example, with reference to the accompanying drawings in which:

FIG. 1 is a front view of a price display device or totem;

FIG. 10 which is a schematic view of a price display device incorporating an alternative counterbalance mechanism.

DETAILED DESCRIPTION OF THE INVENTION

A price totem is generally indicated at 10 in FIG. 1 and includes a shell 11, which defines price windows 12 and 13 and a number changing station 14. It will be seen that the price windows 12 are of double width to display two digits, whilst the price windows 13 are of single width and, in the illustrated embodiment, display tenths of pence after the decimal point.

Figure 2:
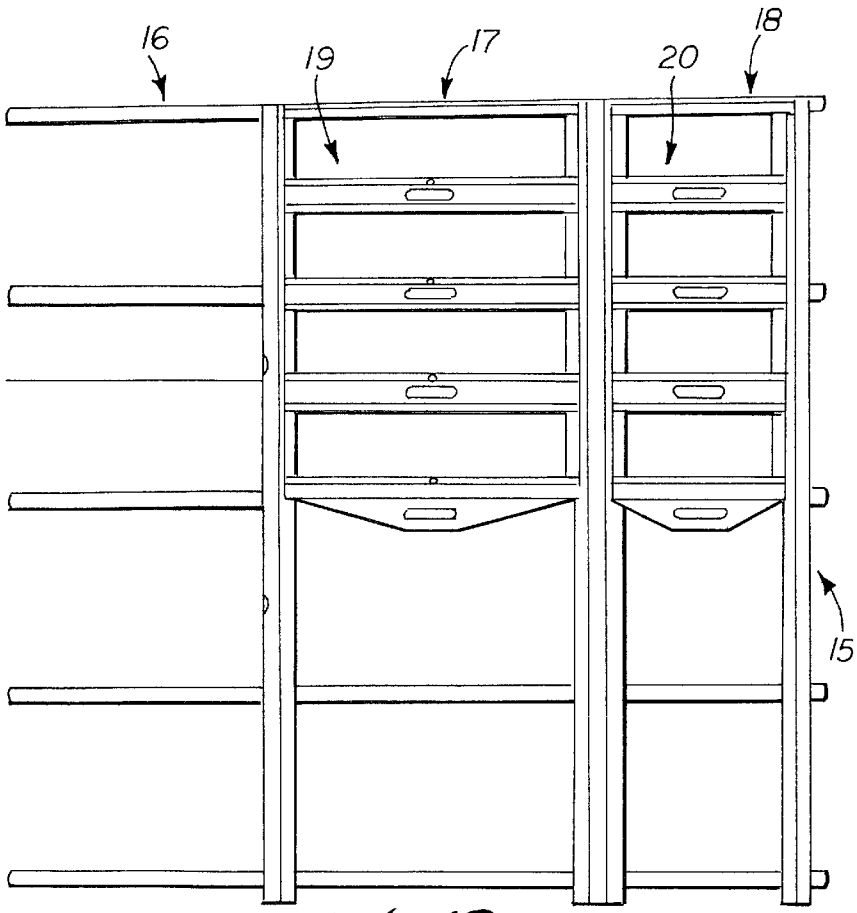
FIG. 2 is a front view of a mechanism for use with that totem.
Figure 6:
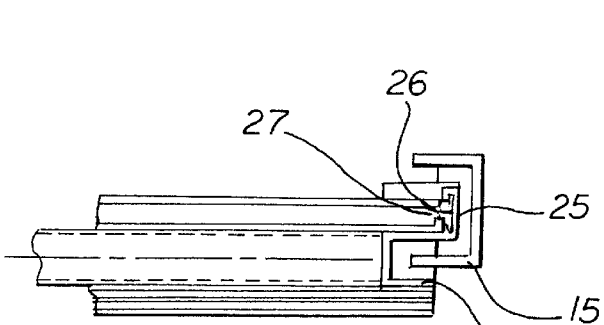
FIG. 6 is a section along the line A—A in FIG. 5.

Contained within the shell 11 is an indicating mechanism generally indicated at 15 in FIG. 2. The mechanism 15 comprises of frame 16 which defines a pair of slide ways 17 and 18 for respective carriages 19, 20, but these can conveniently be replaced by a single full-width carriage as illustrated in the subsequent Figures.

In use the carriage or carriages can be pulled down progressively from the display position illustrated in the drawing so that each number location 23 becomes aligned, in turn, with the number changing station 14 when the operator has opened the station to obtain access to the mechanism 15. The totem is provided with a recess below the number changing station 14 to receive the lower parts of the carriage. In previous designs this recess had to be sufficiently tall to accommodate all but the upper most number location, but as has been indicated this is not always possible, when there is either reduced space available or there are a greater number of number locations.

Figure 3:
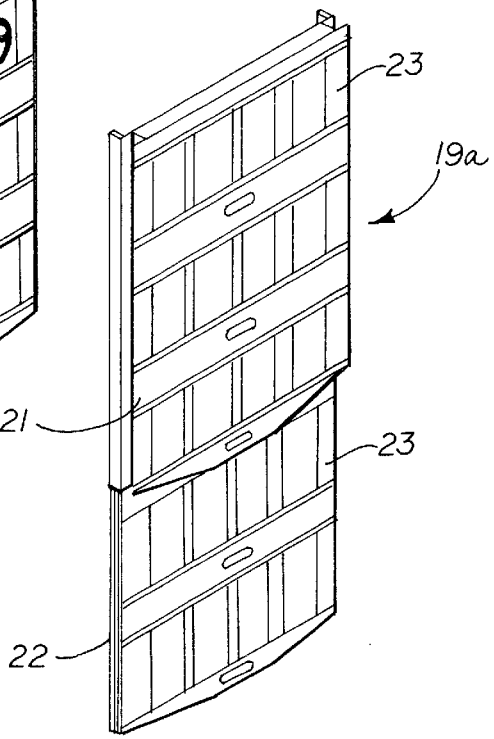
FIG. 3 is a perspective view of a carriage in its extended position.
Figure 4:
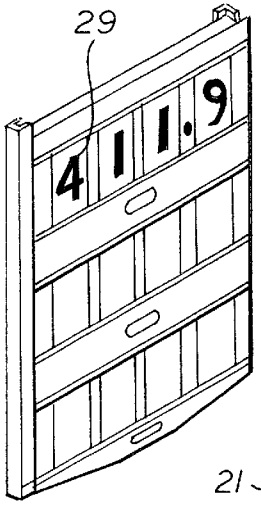
FIG. 4 is a similar view of the carriage in its contracted position.

FIGS. 3 and 4 illustrate a full-width carriage 19*a*, which has upper and lower portions 21, 22 each of which have respective number locations 23. Thus in the illustrated example the upper portion has three number locations and the lower portion has two. As will be explained in more detail below, the lower portion 22 is mounted on the upper portion 21 so that it can slide up behind the upper portion 21 to contract the carriage 19*a* into the arrangement shown in FIG. 4. It will readily be appreciated that this contraction feature enables the price mechanism of the type generally described in British Patent No. 2289156B to be used even when the height of the recess below the number changing station 14 is significantly less than the vertical height of the carriage. Thus, in the example illustrated in FIGS. 3 and 4, a carriage which provides five number locations 23 can be accommodated in a recess, which would previously have only been sufficient for use with a three number location carriage. As the principle members of the upper and lower portions 21, 22 are formed from extrusions, it is extremely easy to make up the carriage portions with whatever arrangement of number locations is appropriate for a particular site.

Turning to FIGS. 5 to 9, the side edges at 24 of the upper portion 21 are formed from an outwardly facing generally U-shaped extrusion 24, which has an orthogonal extension 25 on it's rear leg that defines an inwardly-facing restricted-mouth groove 26. This receives a cooperatively formed extrusion 27 on the edge of the lower portion 22, allowing the lower portion 22 to slide along the groove 26. The carriage 19*a* may be mounted on the frame 15 by any of a number of means known in the art. In a preferred embodiment, the carriage is mounted on the frame by a spring loaded mechanism of the type generally described in the above mentioned British Patent.

Figure 8:
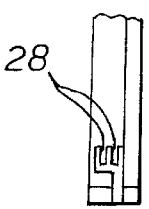
FIG. 8 is a scrap section along the line C—C.
Figure 7:
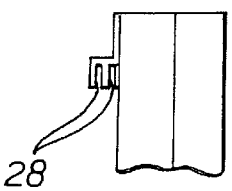
FIG. 7 is a scrap section along the line B—B.
Figure 9:
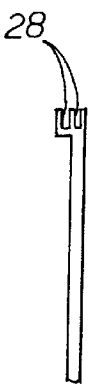
FIG. 9 is a scrap section along the line D—D.
Figure 5:
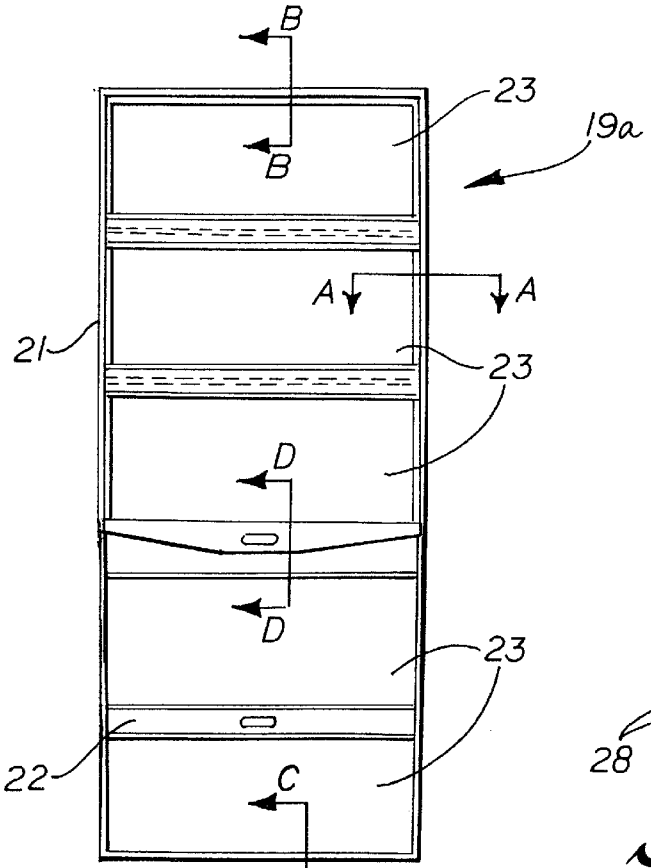
FIG. 5 is a front view of the carriage of FIG. 3.

As can be seen from FIGS. 7 to 9, the number locations are provided with pairs of channels or grooves 28 for receiving sheets of material. The rearward groove typically receives a number bearing sheet, as shown at 29 in FIG. 4, where as the front groove receives a generally transparent cover, which may be coloured yellow, for example, if protection is required against sunlight.

As has been mentioned above the contraction of the carriage 19*a*, when it enters the recess, may simply be effected by the bottom 19*b* engaging the ground or an abutment to break further downward movement of the lower portion 22. The upper portion 21 will then continue to slide downwardly contracting the carriage. When the carriage 19*a* is raised, the weight of the lower portion 22 will generally be sufficient to cause the carriage 19*a* to re-extend, but a temporary locking latch or a weak spring element may be provided to enhance this extension, as has been set out above.

The mechanism, generally indicated 25, includes an outer frame 26, on which is mounted an inner frame 27 defining a vertical slideway 28 along which a carriage 29 can be moved from the elevated price display position indicated to a lower price change position in which it can be accessed by a person standing on the ground. The carriage 29 may have a single price or number location 30 as shown, but equally, and perhaps more usually, it will include a number of vertically spaced locations as illustrated in the above-mentioned Patent and in the preceding description.

Upper and lower pulleys 31, 32 are mounted on the top and bottom of the frame 25. A first cord, rope or chain 33 extends from the top of the carriage 29 around the pulley 31 to the upper end 34 of a centre weight 35, which is constrained for vertical movement by a tube 36. A second cord, rope or chain 37 is attached to the lower end 38 of the weight 35 and extends around the lower pulley 32 to attach to the bottom of carriage 29. Thus, the carriage 29, the cord 33, weight 35 and cord 37 form a closed loop. When the operator pulls downwardly on the second cord, rope or chain 37 at the point X, the carriage is lowered. If the operator pulls upwardly, the carriage is raised. The mechanism is thus suitable for use in price indicating mechanism, such as price totems, whatever the height of the totem.

What is claimed is:

1. An indicating mechanism for a price display device comprising a frame defining a vertical slideway, a carriage slidably mounted in the slideway for movement between a display position and a storage position, the carriage defining a plurality of vertically spaced number locations such that the locations can be successively disposed adjacent a number changing station as the carriage moves between its display and storage positions, characterised in that the carriage comprises upper and lower portions each bearing at least one number location, the portions being movably interconnected for relative vertical sliding movement whereby the carriage can be contracted into the storage position.

2. A mechanism as claimed in claim 1, wherein the lower portion slides behind the upper portion to effect contraction.

3. A mechanism as claimed in claim 2 where the weight of the lower portion is sufficient to extend the carriage when the carriage is raised to the display position.

4. A mechanism as claimed in claim 2 further including a stop or abutment for engaging the lower portion to initiate contraction.

5. A mechanism as claimed in claim 2 including means for urging the carriage into its extended position.

6. A mechanism as claimed in claim 2 including a temporary latch for briefly restraining the lower portion as the carriage is raised to the display position.

7. A mechanism as claimed in claim 1 further including a stop or abutment for engaging the lower portion to initiate contraction.

8. A mechanism as claimed in claim 7 where the weight of the lower portion is sufficient to extend the carriage when the carriage is raised to the display position.

9. A mechanism as claimed in claim 7 including means for urging the carriage into its extended position.

10. A mechanism as claimed in claim 7 including a temporary latch for briefly restraining the lower portion as the carriage is raised to the display position.

11. A mechanism as claimed in claim 7 wherein ground upon which the mechanism stands serves as the stop or abutment.

12. A mechanism as claimed in claim 11 where the weight of the lower portion is sufficient to extend the carriage when the carriage is raised to the display position.

13. A mechanism as claimed in claim 11 including means for urging the carriage into its extended position.

14. A mechanism as claimed in claim 11 including a temporary latch for briefly restraining the lower portion as the carriage is raised to the display position.

15. A mechanism as claimed in claim 1 where the weight of the lower portion is sufficient to extend the carriage when the carriage is raised to the display position.

16. A mechanism as claimed in claim 15 including a temporary latch for briefly restraining the lower portion as the carriage is raised to the display position.

17. A mechanism as claimed in claim 1 including means for urging the carriage into its extended position.

18. A mechanism as claimed in claim 17 including a temporary latch for briefly restraining the lower portion as the carriage is raised to the display position.

19. A mechanism as claimed in claim 1 including a temporary latch for briefly restraining the lower portion as the carriage is raised to the display position.

20. A mechanism as claimed in claim 1 further comprising counterbalance means for counterbalancing the weight of the carriage, including a pulley mounted on the frame above the carriage and a counterbalance weight connected to an upper part of the carriage by a flexible elongate member which passes over the pulley characterised in that the mechanism includes a further pulley located below the number change station and a further flexible member connected to the weight, extending around the further pulley to the lower part of the carriage to form, with the carriage, a closed loop with the counterbalance means, whereby the carriage can be moved vertically in the desired direction by pulling on the further flexible member.

21. An indicating mechanism for a price display device comprising a frame defining a vertical slide way, a carriage mounted in the slideway for movement between a display position and a number change position adjacent a number changing station, the carriage defining a number location and counterbalance means for counterbalancing the weight of the carriage, including a pulley mounted on the frame above the carriage and a counterbalance weight connected to an upper part of the carriage by a flexible elongate member which passes over the pulley characterized in that the mechanism includes a further pulley located below the number changing station and a further flexible member connected to the weight, extending around the further pulley to the lower part of the carriage to form, with the carriage, a closed loop with the counterbalance means, whereby the carriage can be moved vertically in the desired direction by pulling on the further flexible member.

* * * * *